United States Patent [19]

Bayer

[11] 4,238,753

[45] Dec. 9, 1980

[54] TRANSFORMER CORE GAPPING AND LEAD ANCHORING ARRANGEMENT

[75] Inventor: George S. Bayer, Kildeer, Ill.

[73] Assignee: TRW Inc., Wheeling, Ill.

[21] Appl. No.: 911,788

[22] Filed: Jun. 2, 1978

Related U.S. Application Data

[63] Continuation-in-part of Ser. No. 877,728, Feb. 14, 1978, abandoned, which is a continuation of Ser. No. 773,142, Mar. 1, 1977, abandoned.

[51] Int. Cl.[3] ..... H01F 17/06; H01F 27/30

[52] U.S. Cl. ..... 336/178; 336/192; 336/198

[58] Field of Search ..... 336/192, 198, 208, 212, 336/178, 210, 65

[56] References Cited

U.S. PATENT DOCUMENTS

| | | | |
|---|---|---|---|
| 1,505,085 | 8/1924 | Brigham | 336/198 |
| 1,623,143 | 4/1927 | Warren | 336/212 X |
| 1,690,154 | 11/1928 | Alden | 336/212 X |
| 1,763,115 | 6/1930 | Wermine | 336/192 X |
| 1,876,451 | 9/1932 | Gurtler | 336/212 X |
| 1,992,814 | 2/1935 | Cooney | 336/198 |
| 2,375,309 | 5/1945 | McCoy | 336/208 |
| 2,825,849 | 3/1958 | Lufkin et al. | 336/198 X |
| 3,011,140 | 11/1961 | Mittermaier et al. | 336/198 |
| 3,131,371 | 4/1964 | Brekke et al. | 336/192 |
| 3,195,086 | 7/1965 | Taylor | 336/178X |
| 3,212,397 | 10/1965 | Broverman | 336/208 X |
| 3,213,399 | 10/1965 | Hurley | 336/212 |
| 3,273,099 | 9/1966 | Minks | 336/178 X |
| 3,315,198 | 4/1967 | Biesma et al. | 336/192 |
| 3,354,417 | 11/1967 | Davis | 336/192 X |
| 3,533,036 | 10/1970 | Wood | 336/208 X |
| 3,652,968 | 3/1972 | Johnston et al. | 336/208 X |
| 3,665,358 | 5/1972 | Leuck et al. | 336/192 X |
| 3,671,903 | 6/1972 | Arrington et al. | 336/192 X |
| 3,766,643 | 10/1973 | Arrington et al. | 336/192 X |
| 3,946,350 | 3/1976 | Goto | 336/208 |
| 4,095,206 | 6/1978 | Hishiki | 336/178 X |
| 4,099,510 | 7/1978 | Perrier et al. | 336/178 X |

FOREIGN PATENT DOCUMENTS

| | | | |
|---|---|---|---|
| 2311612 | 9/1973 | Fed. Rep. of Germany | 336/208 |
| 1394650 | 2/1965 | France | 336/212 |
| 1250827 | 10/1971 | United Kingdom | 336/198 |

*Primary Examiner*—Thomas J. Kozma

*Attorney, Agent, or Firm*—Neuman, Williams, Anderson & Olson

[57] ABSTRACT

A transformer formed of primary and secondary coils wound concentrically about a bobbin and maintained in spaced relation by a precision spacer. Two symmetric, L-shaped, ferrite core elements are mounted to form a magnetic flux path for flux generated by the coils; these core elements are maintained, at least partially, in spaced relation by flanges of the bobbin, thereby forming two gaps which may be of relatively large dimension. One of the flanges includes wire passageways and spaced holes for providing electrical connection, with strain relief, to the coils of the transformer.

6 Claims, 14 Drawing Figures

FIG. 3
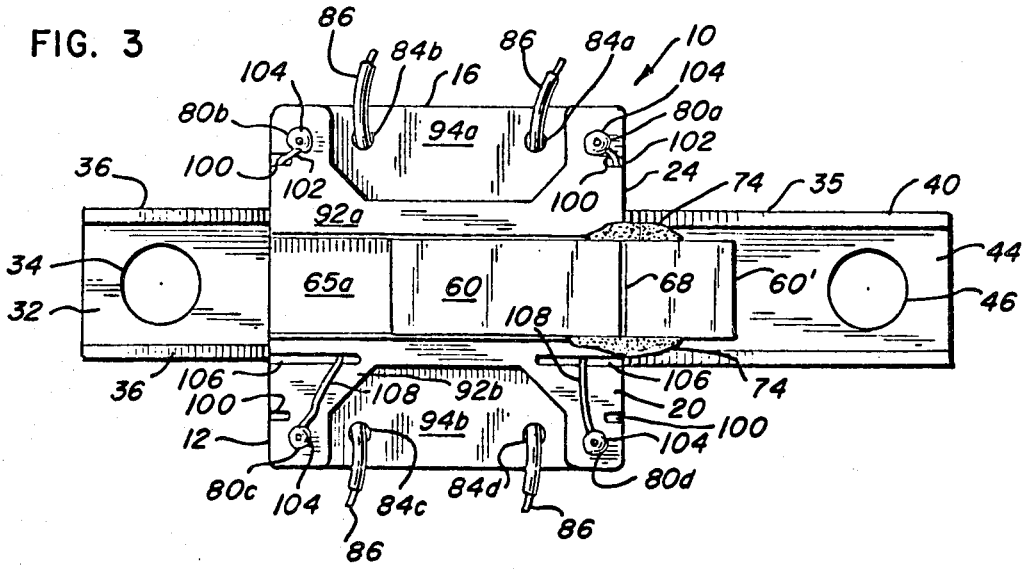
FIG. 5
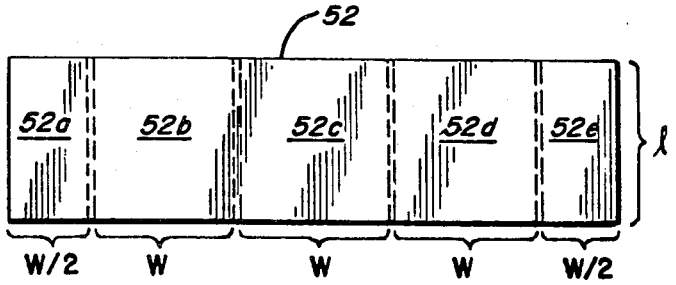
FIG. 6
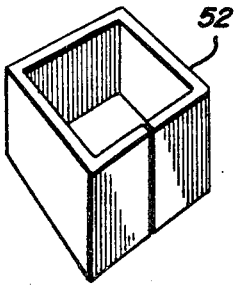
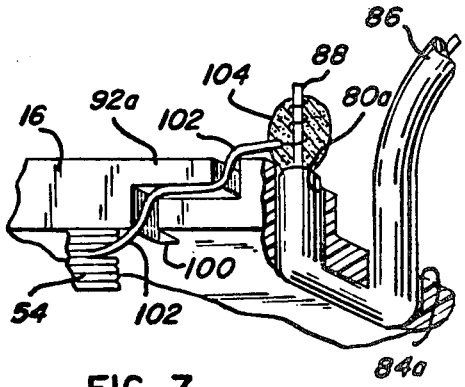
FIG. 7

FIG. 11
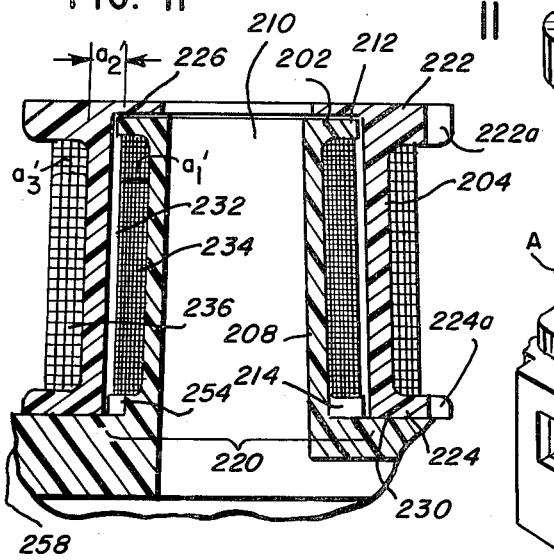
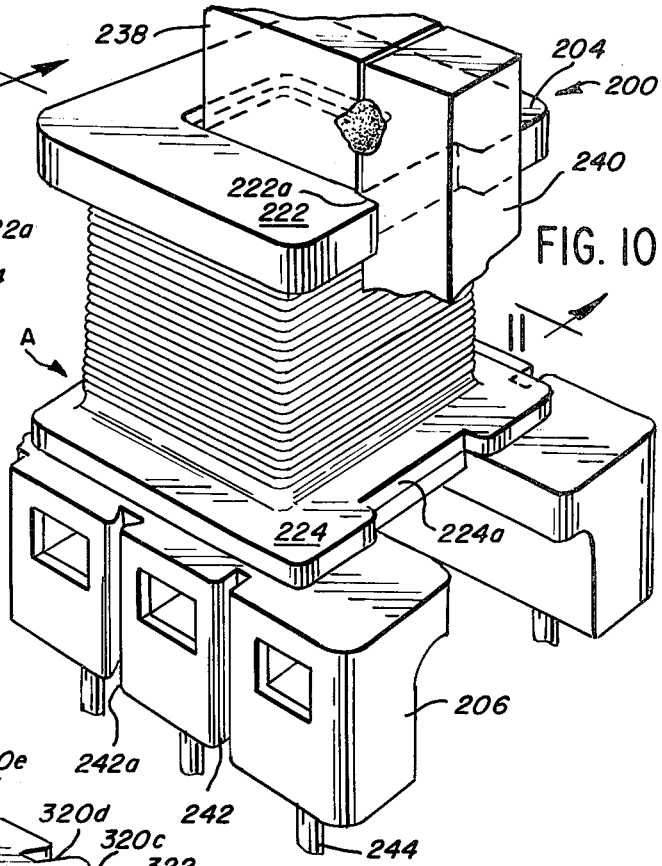
FIG. 10
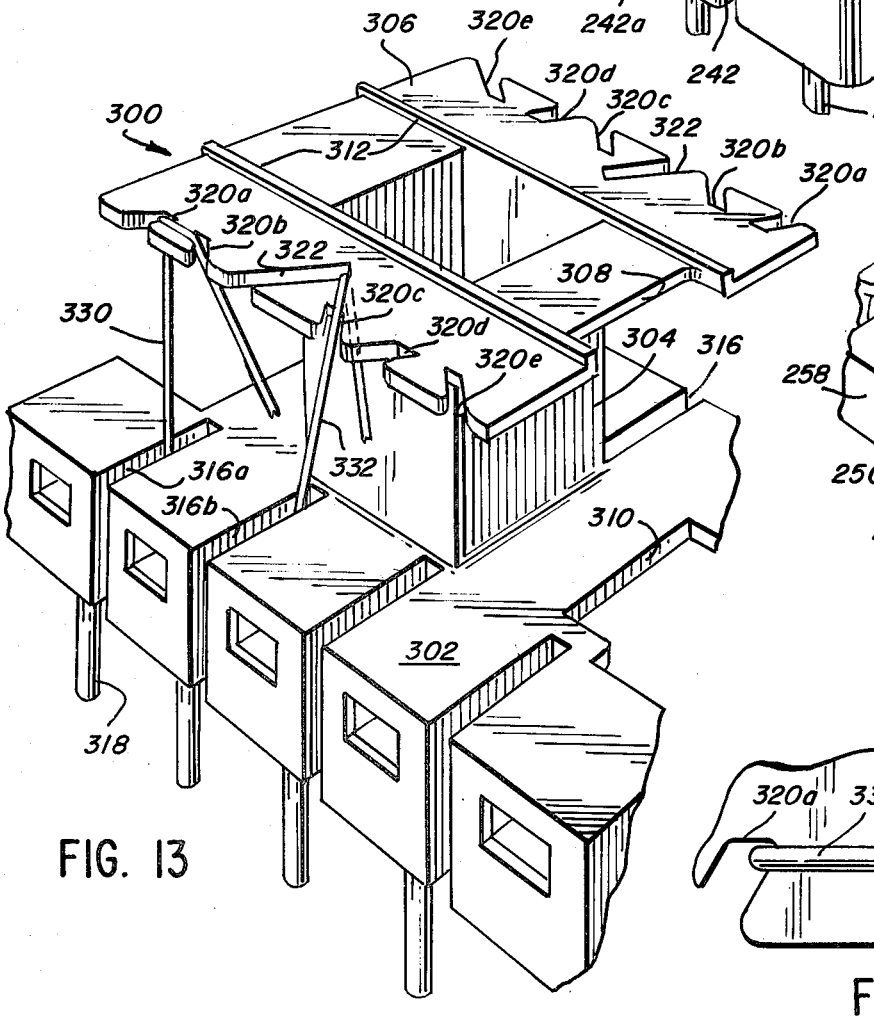
FIG. 13
FIG. 12
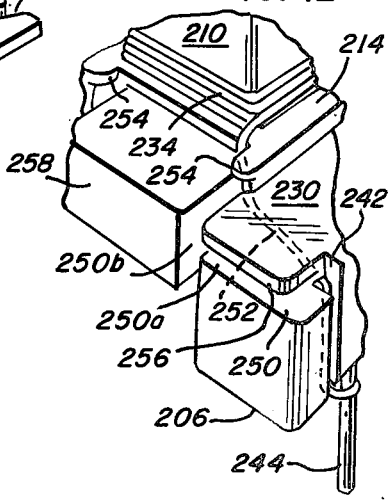
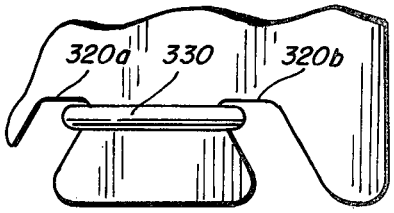
FIG. 14

TRANSFORMER CORE GAPPING AND LEAD ANCHORING ARRANGEMENT

This application is a continuation-in-part of application Ser. No. 877,728, filed Feb. 14, 1978, now abandoned which is a continuation of application Ser. No. 773,142, filed Mar. 1, 1977, now abandoned.

This invention relates to the field of transformers and, more specifically, to driver transformers for switching transistor drive circuitry.

In modern television receivers, particularly solid state television receivers, transformers have been employed in horizontal control circuits to perform a number of functions including providing impedance transformation to improve power transfer, e.g., from a horizontal driver transistor to a horizontal output transistor, and providing circuit isolation between a driver circuit and an output circuit. Exemplary transformers which have been or may be used in television horizontal drive circuitry or embody principles usable in such transformers are disclosed in the following patents: U.S. Pat. No. 3,213,399 issued to R. E. Hurley on Oct. 19, 1965; U.S. Pat. No. 3,533,036 issued to F. A. Wood on Oct. 6, 1970; U.S. Pat. No. 3,671,903 issued to W. L. Arrington, et al. on June 20, 1972; U.S. Pat. No. 3,766,643 issued to W. L. Arrington, et al. on Oct. 23, 1973.

Moreover, in television horizontal deflection circuits, driver transformers have been employed to turn a switching (output) transistor on and off, providing the appropriate deflection current sawtooth wave form, synchronized with the video signals. Switching energies required are relatively high and switching times are relatively short. Therefore, the transistor switch requires peculiar base drive current characteristics. In this regard it is to be noted that the leakage inductance of the secondary winding of a horizontal driver transformer may be employed to store and release energy in the base circuit of a horizontal output transistor to afford base/emitter stored charge removal and improve life and reliability of the output transistor.

Theoretical leakage inductance characteristics of transformers have been known for many years with analysis of certain aspects of such transformers having been reported in reference literature such as *Radio Engineers' Handbook*, McGraw-Hill Book Company, Inc., 1943, Pages 97–101. More recently, considerations for drive circuitry design have been described in "*Driver Circuit Design Considerations For High Voltage Line Scan Transistors*", Proceedings of the I.E.E.E., BTR 19, No. 2, 1972, pages 127–135. Even so, the problem of producing a suitable, while relatively simple, horizontal driver transformer, under economical manufacturing conditions, with reasonably high production yield and yet a close tolerance on leakage inductance has gone unsolved. This is due, in part at least, to the manufacturing practice, common in the horizontal driver transformer industry, of separating a primary and an overwound secondary winding by layers of electrical insulating tape which may stretch and/or conform to the shape of the underlying primary winding, thereby causing imprecise and nonuniform spacing between the windings and variability in leakage inductance.

Since the leakage inductance of a transformer driving a high power transistor switch is a significant parameter, particularly in horizontal drive circuitry, it is desirable that the value of such leakage inductance be maintained within reasonable tolerance limits without unduly increasing the cost of manufacture nor reducing production yield below a reasonable level under normal production conditions. Similar observations obtain in regard to other inductance and frequency response parameters of such a transformer.

Accordingly, it is an object of this invention to provide an improved transformer for use in transistor switch drive circuitry, including television horizontal drive circuitry.

It is a more specific object of this invention to provide a transformer of such physical structure that its inductance parameters, particularly its secondary winding leakage inductance, are within predetermined tolerances and such structure is yet capable of being manufactured economically.

These and other objects and features of the invention will become apparent upon a reading of the following specification in combination with the attached drawings and appended claims.

In an illustrative embodiment of the invention, a transformer comprises a bobbin including a central channel and mutually spaced first and second flanges extending from the central channel. The central channel is overwound with a primary coil and a secondary coil, spaced apart by a spacer of precise thickness. The channel supports the longer portion of an L-shaped ferrite core; a second such L-shaped core is positioned adjacent the first L-shaped core and maintained, at least partially, in spaced relation with the first core by means of the aforementioned flanges.

For a more specific understanding of this invention, reference should now be had to the drawings attached hereto, illustrating a preferred embodiment serving as an example of the invention, wherein:

FIG. 3 shows a top view of the transformer shown in FIG. 1;

FIG. 5 shows a development of a die-cut spacer for use in the transformer shown in FIG. 1;

FIG. 6 shows an isometric view of a molded spacer for use in the transformer shown in FIG. 1;

FIG. 7 shows a partial isometric view of the transformer shown in FIG. 1 in the direction of the arrows 7;

FIG. 10 shows a partial isometric view of a transformer employing an alternative two part bobbin and spacer, according to the invention;

FIG. 11 shows a partial sectional view of the transformer shown in FIG. 10 in the direction of the arrows 11—11;

FIG. 12 shows a partial isometric view of an inner portion of the bobbin, including a coil thereon, and base of the transformer shown in FIG. 10 in the direction of the arrow A thereof;

FIG. 13 shows a partial isometric view of an alternative bobbin for a transformer according to the invention, with selected partial coil leads shown thereon; and FIG. 14 shows a partial top view of the bobbin shown in FIG. 13.

Figure 1:
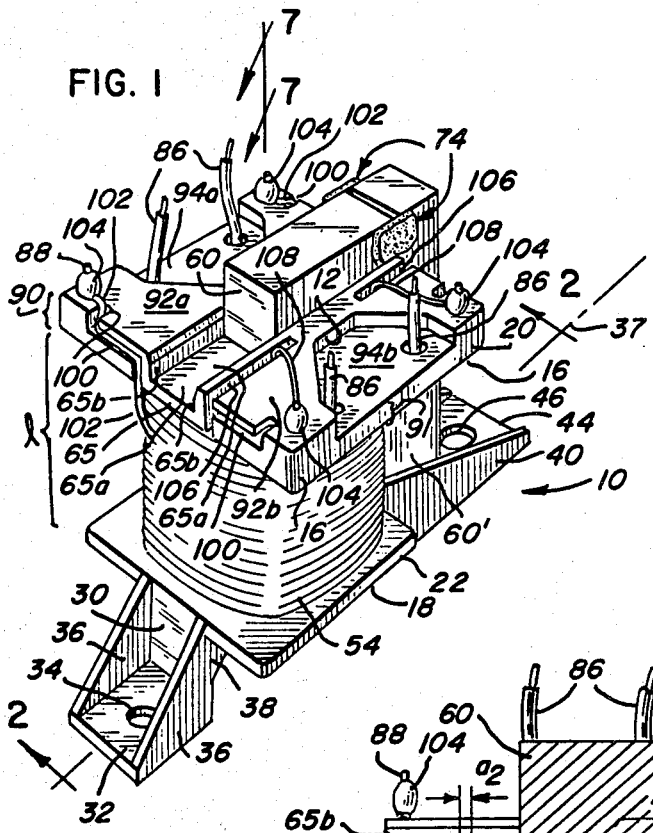
FIG. 1 shows an isometric view of a transformer according to this invention.
Figure 4:
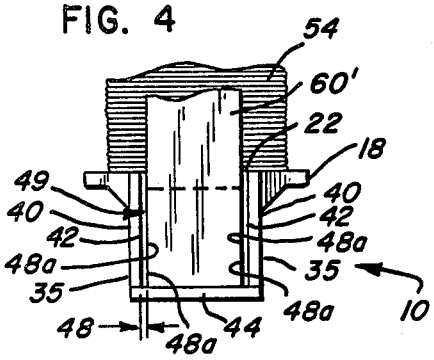
FIG. 4 shows a partial end view of the transformer shown in FIG. 1 in the direction of the arrow 4.

Referring to FIGS. 1-4, a transformer embodying principles of this invention is shown generally at 10. The transformer includes a bobbin 12 of an appropriate plastic material which is dimensionally stable with temperature, humidity, impact, etc., such as polypropylene thermoplastic. The bobbin 12 includes a hollow, central channel portion 14 which, in the preferred embodiment, is square in crosssection and adjoined at its ends by flanges 16 and 18, respectively, which are generally rectangular and perpendicular to the channel portion 14. The flanges 16 and 18 completely surround the channel portion 14 and include portions 20 and 22, respectively, extending rearwardly and terminating in end surfaces 24 and 26, respectively. The end surface 24 is displaced a distance 28 from an inner surface 29 of the central channel portion 14 and, in the preferred embodiment, the end surface 26 is also displaced a distance 28 from the surface 29. It is contemplated, however, that in some embodiments of this invention, the end surfaces 24 and 26 may be displaced to different distances from the surface 29.

Figure 2:
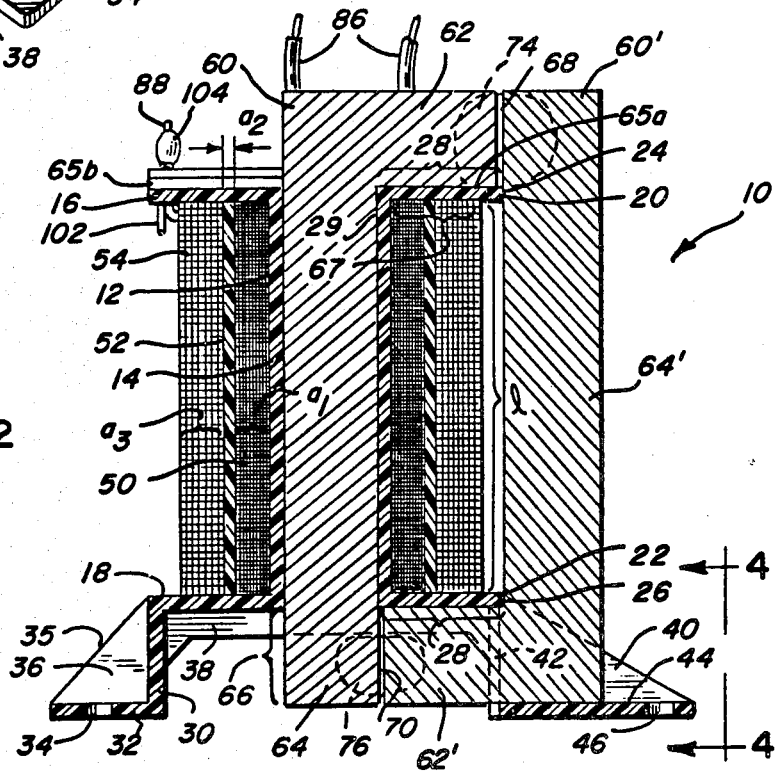
FIG. 2 shows a cross-section of the transformer shown in FIG. 1 in the direction of the arrows 2—2.

The flange 18 is connected at its forward end to an integrally molded support leg 30 which extends at a right angle to the flange 18, vertically downward as viewed in FIG. 2. The support leg 30 is, in turn, connected to a perpendicular support member 32 which includes a mounting hole 34 extending therethrough. The member 32 is flanked on each side by and integrally connected to reinforcement ribs 35 which are equally displaced from and parallel to a plane, represented by the center line 37 (FIG. 1), bisecting the transformer 10; the ribs 35 include a portion 36 extending, as viewed in FIG. 2, angularly downward from the forward end of the flange 18 to the forward end of the member 32. The ribs 35 also include integral portions 38 beneath the flange 18 and extending rearwardly from the support leg 30, to which the ribs 35 are integrally connected, to the vicinity of the rear surface 26 of the flange 18. There, the portions 38 are, respectively, integrally connected to rib portions 40 which flank two support legs 42 and a support member 44; the member 44 includes a mounting hole 46 extending therethrough. It should here be noted that the support legs 42 extend inwardly from the ribs 35 a predetermined distance 48 to respective end surfaces **48*a*. As a result, a passageway 49 is provided (best seen in FIG. 4), which in the preferred embodiment is square, bounded by the undersurface of the flange portion 22, the end surfaces 48*a* and the support member 44**.

A primary coil 50 is wound about the central channel portion 14. The coil 50 of a number of turns $N_1$ is wound, in the preferred embodiment, as precisely as possible to a thickness $a_1$, which, for illustration only, may be approximately 0.05 inches. Surrounding the coil 50 is a rigid spacer 52, which will be described in more detail below, of a precise thickness $a_2$, which, for illustration only, may be 0.015 inches. A secondary coil 54 of a number of turns $N_2$ is wound about the spacer 52 and, in the preferred embodiment, the coil 54 is wound as precisely as possible to a thickness $a_3$, which, for illustration only, may be approximately 0.06 inches. The rigid spacer 52, facilitates precision winding of the coil 54 in that such spacer provides an unyielding, uniform winding form for the coil which is substantially unaffected by any nonuniform character of the underlying primary coil. Moreover, such precision winding of coil 54 on the uniform spacer 52 promotes uniformity of means secondary coil circumference from one transformer to another in manufacture. Both coils 50 and 54 are of substantially the same length, namely a length 1, determined by the displacement of the flange 16 from the flange 18. Similarly, the spacer 52 is also of the length 1, which, for illustraction only, is approximately 0.4 inches.

As indicated above, the thickness of the spacer 52 is maintained precisely, i.e., within close tolerance, to the dimension $a_2$. The tolerance of this dimension is, in the preferred embodiment, plus or minus 5%. It has been observed that such a tolerance on the dimension $a_2$ and, thus, the thickness of the spacer 52 results in an improvement in production yield of transformers having a secondary leakage inductance within desired and relatively close tolerance limits, e.g., plus or minus 5%.

To ensure that the spacer 52 maintains its precision thickness over time, the spacer 52 is formed of a temperature and humidity stable material, which is relatively hard and resistant to deformation which would conform the spacer to any undulations or variations in thickness of the primary coil 50. In the preferred embodiment of this invention, the spacer 52 is formed of a die-cut strip of insulating material which is dimensionally stable with temperature, humidity, impact, etc. One commerically available material suitable for this use is NOMEX type 410 nylon paper manufactured by E. I. DuPont De Nemours & Co., Inc. Such a spacer is shown in development in FIG. 5 and includes portions **52*a*, 52*b*, 52*c*, 52*d*, and 52*e*, separated by scorings to facilitate forming the spacer into a square parallelepiped having sides of width just sufficient to permit the spacer to surround the aforementioned coil 50. As can be observed in FIG. 5, the portions 52*b*, 52*c*, and 52*d* are of equal width dimension w and the two end portions 52*a* and 52*e* collectively equal the width dimension w of the other portions; for illustration only, the portions 52*a* and 52*e*** are each shown in FIG. 5 as having width dimension w/2.

Alternately, the spacer 52 may be molded as shown in FIG. 6 in the form of a discontinuous square parallelepiped, otherwise as above described. In such circumstance, it remains necessary to employ a hard material of appropriate stable temperature and humidity characteristics such as thermoplastic, which is sufficiently resilient to permit the parallelepiped to be temporarily deformed during manufacture to permit the spacer to be placed about the coil 50. One commercially available material suitable for this use is NORYL SE-1 manufactured by the General Electric Company.

Further, in one embodiment of this invention, the dimension $a_2$ is selected substantially greater than one-third of the sum of the dimensions $a_1$ and $a_3$. By so doing, the effect upon leakage inductance of the dimensions $a_1$ and $a_3$, the thickness of the primary and secondary coils, is greatly diminished. These coil thicknesses, $a_1$ and $a_3$, are difficult to maintain within precise bounds during manufacture due to normal variations in wire diameter, wire coating thickness and the random buildup of the wire turns of the coil. However, since an increase in the dimension $a_2$ increases the leakage inductance, it is necessary to compensate for such increase to obtain a particular leakage inductance; in such event, the length 1 of the coils 50 and 54, which can be precisely controlled in manufacture, is increased; in this embodiment, for illustration only, the length 1 is equal to 0.72 inches. The effect of such an increase in coil lengths is two-fold in that an increase in such coil lengths directly reduces leakage inductance and indirectly reduces the dimensions $a_1$ and $a_3$, since the respective coil turns may be spread over a larger length thereby decreasing the thickness of the respective coils; in this embodiment, for illustration only, $a_1$ is approximately equal to 0.028 inches and $a_3$ is approximately equal to 0.033 inches. By reducing the dimensions $a_1$ and $a_3$, the value of $a_2$ necessary for $a_2$ to be substantially greater than onethird of the sum of the dimensions $a_1$ and $a_3$ is reduced; in this embodiment, for illustration only, $a_2$ is equal to 0.07 inches.

An L-shaped core member 60 including a horizontal leg 62 and a vertical leg 64, as viewed in FIG. 2, is mounted with the leg 64 inserted within the central channel portion 14. The central channel portion 14 and the member 60 are of such cross-sectional dimension as to permit the leg 60 to slidably engage the channel 14 and yet be firmly held in position therein. The leg 64 is of such length and is inserted into the channel 14 to the point that the leg 62 rests against the flange 18 in a U-shaped groove 65, having a bottom surface 65*a* and beveled side walls 65*b* extending parallel to the plane 37 and mutually spaced to securely receive such leg; a lower segment 66 of the leg 64 extends beyond the flange 18.

An L-shaped core member 60', similar in all respects, in the preferred embodiment, to the core member 60, and including a horizontal leg 62' and a vertical leg 64', is mounted with the vertical leg 64' engaging the surfaces 24 and 26 of the flanges 16 and 18, respectively, and with the leg 62' resting against the flange portion 22. In such position the leg 62' passes through the aforementioned passageway 49; further, the cross-section of the leg 62' and the passageway 49 are such as to permit the leg 62' to slidably engage the passageway 49 and yet to be held firmly in position therein.

Here it should be noted that, in the preferred embodiment, the legs 62 and 62', respectively, extend from the legs 64 and 64' to a length which is slightly less than the aforementioned distance 28. As a result, gaps 68 and 70 are formed between legs 62 and 64' and legs 64 and 62', respectively. These gaps may be filled with air or with an appropriate paper or other non-magnetic material. In an alternative embodiment of the invention, a solid material filling the gap(s) may be of such thickness as to prevent the leg 64' from engaging one or both of the surfaces 24 and 26, thereby creating a larger gap than would otherwise be the case. In addition, the surfaces 24 and 26 may be displaced different distances from the channel portion 14 and the legs 62 and 62' may be of different lengths. In the preferred embodiment, however, the legs 62 and 62' are of the same length, as indicated above.

In addition, in the preferred embodiment the core members 60 and 60' are both constructed of ferrite material to achieve improved frequency response characteristics desirable for driver transformers and for reduced operating temperatures (as compared with more common laminated silicon steel core material). Moreover, the aforementioned gaps 68 and 70 may be of substantially greater dimension than in conventional transformers (e.g., on the order of between 0.010 and 0.015 inches rather than between 0.003 and 0.006 inches) which permits the construction of the transformer without necessarily precision grinding the opposing surfaces of the two core member 60 and 60' forming the gaps 68 and 70 to remove a variable thickness non-magnetic skin which may form thereon during manufacture. With such larger gaps, however, increased numbers of turns, $N_1$ and $N_2$, e.g., on the order of twice the number employed with smaller gaps, may be employed to achieve necessary transformer inductance.

The two core members are bonded together to insure structural integrity. More specifically, suitable epoxy resin bonds 74 and 76, respectively, are applied on opposing sides of the core members in the vicinity of the gaps 68 and 70. The resin may be any one of a number of commercially available resins such as Eccobond No. 285 manufactured by Emerson & Cumings, Inc. A second resin is generally applied to the transformer by vacuum impregnation, a process known to those skilled in the art to which this invention pertains, after transformer construction is otherwise complete. Again, any one of a number of commercially available resins may be employed, such as one-part epoxy resin No. 468-2 manufactured by Ripley Resin Engineering Company, Inc. or a silicone resin such as DC 997 by Dow Corning Company. This second resin bonds the core members securely and can be used in addition to or instead of the bonds 74 and 76. In the preferred embodiment, the bonds 74 and 76 are employed with the second resin.

The bonds 74 and 76 and the second resin cooperatively operate with the channel portion 14, the flange 16 and groove 65, the passageway 49 and, in the preferred embodiment, the surfaces 24 and 26 to maintain the two core members rigidly affixed to the bobbin 12 and in appropriate mutual relationship, thereby effectively forming a rectangular transformer core, disposed generally parallel to the aforementioned plane 37, having gaps 68 and 70 therein. Further, the gaps 68 and 70 are displaced from the coils 50 and 54 and eddy current generation due to the gap flux fringing effects is reduced from that obtaining with other structures wherein the gaps are placed within the coils.

Referring to FIGS. 1, 3 and 7 the flange 16 includes four holes 80, consisting of holes 80*a*, 80*b*, 80*c*, and 80*d*, positioned, respectively, at the four corners of the flange. Adjacent each of these holes and mutually spaced therefrom, respectively, are holes 84, consisting of holes 84*a*, 84*b*, 84*c*, and 84*d*; the holes 84*a* and 84*b* are disposed generally along the perimeter of the flange 16 and on one side thereof, and the holes 84*c* and 84*d* are disposed generally along the perimeter of the flange 16 and on an opposite side thereof. Lead wires 86 are passed downward through the holes 84, which are of a diameter slightly larger than the insulation on the lead wires; these lead wires are bent in rather sharp right angles. As can be seen most clearly in FIG. 7, they are returned through the respective holes 80 which are of a diameter just sufficiently larger than the diameter of the lead wire insulation to permit the lead wire to be slidably passed through the hole.

The respective lead wires are appropriately stripped and inserted into the holes 80 to point that the end of insulation adjoining each of the stripped portions 88 is approximately even with the surface of the flange 16. Thus, the stripped portions 88 of the respective lead wires serve as effective binding posts for connection to the coils 50 and 54.

Here the topography of the upper surface of flange 16 should be noted. More specifically, the flange includes C-shaped portions 92*a* and 92*b*, respectively, on each side of the groove 65 which are of a thickness 90 substantially greater than a thickness 91 of portions 94*a* and 94*b* which are, respectively, partially surrounded by the portions 92*a* and 92*b*. The holes 80 are in the portions 92*a* and 92*b* of thickness 90, while the holes 84 are in portions 94*a* and 94*b* of thickness 91. The increased thickness of the portions through which the holes 80 pass provides both additional strength to the flange generally and additional support for the lead wires 86 beneath the stripped portions 88.

The flange portions 92*a* and 92*b* include double L-shaped passageways 100 integrally formed in the forward and rearward surfaces thereof and extending inwardly to the vicinity of the coil 54. Coil end wires 102 from the secondary coil 54 are passed through the passageways 100, respectively, and terminated by means of a solder bulb 104 on the stripped portions 88 of the lead wires 86 positioned in holes 80*a* and 80*b*. Further, the portion 92*b* includes a slot 106 adjoining a double L-shaped passageway 100 and extending rearwardly from the forward surface thereof to the vicinity of the primary coil 50; a similar slot 106 extends forwardly from the rearward surface of the flange 16. Coil end wires 108 extending from the primary coil 50 are passed through the slots 106, respectively, and terminated by means of a solder bulb 104 on the stripped portions 88 of the lead wires 86 positioned in holes 80*c* and 80*d*. The solder bulbs 104 are sufficiently large to inhibit withdrawal of the lead wires 86 from the hole 80 and the cooperative operation of the respective pair of holes 80 and 84 together with the two rather sharp right angle bends in each of the lead wires 86 provide strain relief for the lead wires 86.

Figure 8:
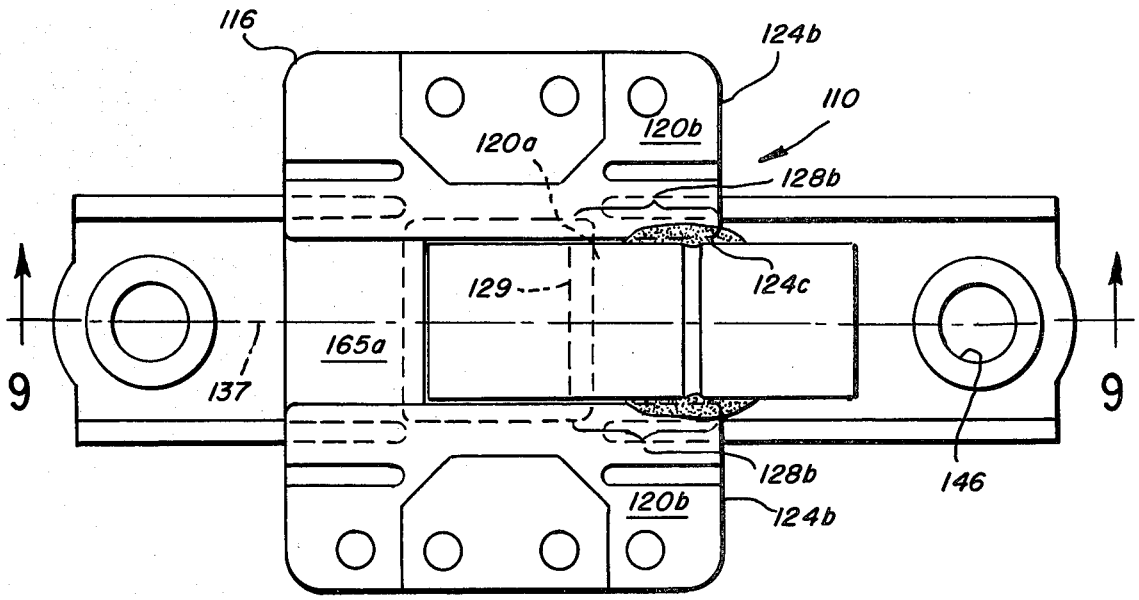
FIG. 8 shows a top view of an alternative embodiment of the invention.
Figure 9:
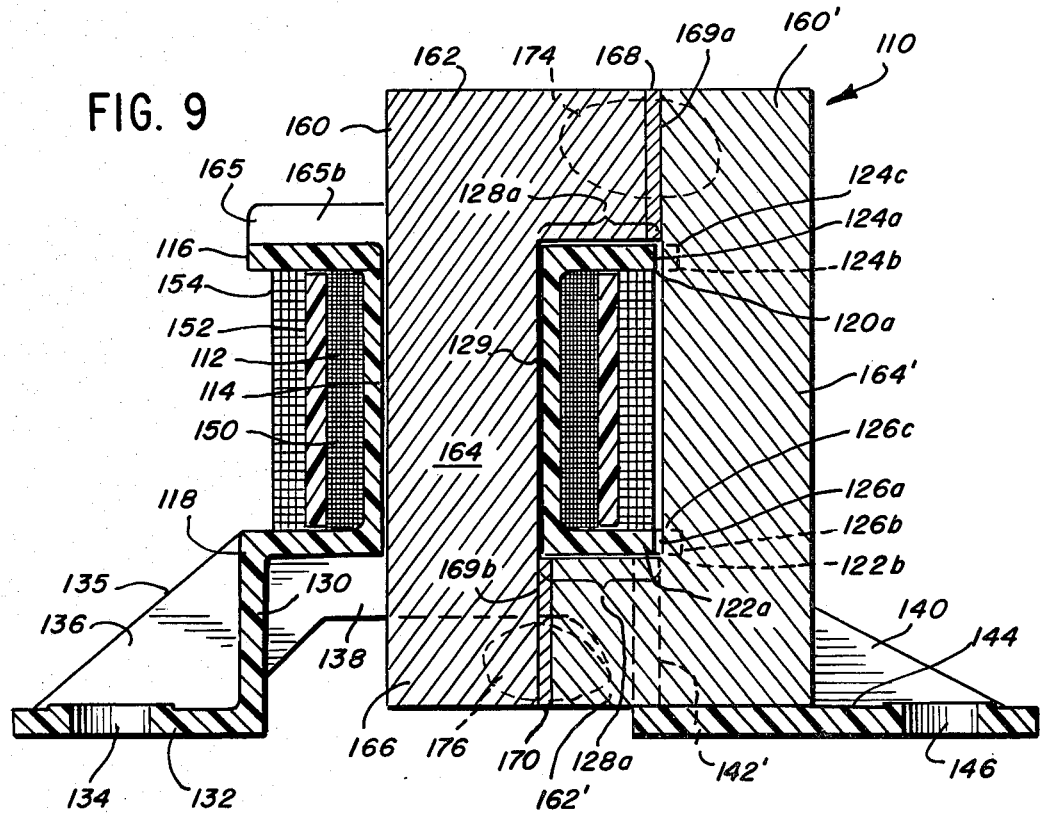
FIG. 9 shows a cross-section of the transformer shown in FIG. 8 in the direction of the arrows 9—9.

Referring to FIGS. 8 and 9, a transformer also embodying principles of this invention is shown generally at 110 in somewhat simplified form without terminals and leads. The transformer includes a bobbin 112 somewhat similar to the bobbin 12 having a hollow, central channel portion 114 which, in the preferred embodiment, is square in cross-section and adjoined at its ends by flanges 116 and 118, respectively, which are generally rectangular and perpendicular to the channel portion 14. The flanges 116 and 118 include portions 120*a* and 122*a*, respectively, extending rearwardly and terminating in end surfaces 124*a* and 126*a*, respectively. The end surface 124*a* is displaced a distance 128*a* from an inner surface 129 of the central channel portion 114 and, in the preferred embodiment, the end surface 126*a* is also displaced a distance 128*a* from the surface 129. The flange 116 also includes portions 120*b* adjoining each side of the portion 120*a*. Each of the portions 120*b* terminate in end surfaces 124*b* which are displaced a distance 128*b*, greater that the distance 128*a*, from the surface 129. The surfaces 124*a* and 124*b* thus form a notch or recess 124*c* in the flange 116. In like manner, the flange 118 includes portions 122*b* having end surfaces 126*b* which, with surface 126*a*, form notch or recess 126*c*.

The flange 118 is connected at its forward end to an integrally molded support leg 130 which extends at a right angle to the flange 118, vertically downward as viewed in FIG. 9. The support leg 130 is, in turn, connected to a perpendicular support member 132 which includes a mounting hole 134 extending therethrough. The member 132 is flanked on each side by an integrally connected to reinforcement ribs 135 which are equally displaced from and parallel to a plane, represented by the center line 137 (FIG. 8), bisecting the transformer 110; the ribs 135 include a portion 136 extending, as viewed in FIG. 9, angularly downward from the forward end of the flange 118 to the forward end of the member 132. The ribs 135 also include integral portions 138 beneath the flange 118 and extending rearwardly from the support leg 130, to which the ribs 135 are integrally connected, to the vicinity of the rear surface 126*a* of the flange 118. There, the portions 138 are, respectively, integrally connected to rib portions 140 which flank two support legs 142 and a support member 144; the member 144 includes a mounting hole 146 extending therethrough.

A primary coil 150 similar to the coil 50 is wound about the central channel portion 114. Surrounding the coil 150 is a rigid spacer 152, similar to the spacer 52, which may be made of MOPLEN CR080 A by Novamont Company. A secondary coil 154 similar to the coil 54 is wound about the spacer 152.

An L-shaped core member 160 including a horizontal leg 162 and a vertical leg 164, as viewed in FIG. 9, is mounted with the leg 164 inserted within the central channel portion 114. The central channel portion 114 and the member 160 are of such cross-sectional dimension as to permit the leg 160 to slidably engage the channel 114 and yet be firmly held in position therein. The leg 164 is of such length and is inserted into the channel 114 to the point that the leg 162 rests against the flange 118 in a U-shaped groove 165, having a bottom surface 165*a* and side walls 165*b* extending parallel to the plane represented by the center line 137 and mutually spaced to securely receive such leg; a lower segment 166 of the leg 164 extends beyond the flange 118.

An L-shaped core member 160′, similar in all respects, in the preferred embodiment, to the core member 160, and including a horizontal leg 162′ and a vertical leg 164′, is mounted with the vertical leg 164′ displaced from the surfaces 124*a* and 126*a*; the leg 164′ is positioned within the notches 124*c* and 126*c* of the flanges 116 and 118, respectively. Gaps 168 and 170 are formed between legs 162 and 164′ and legs 164 and 162′, respectively; and maintained by spacers 169*a* and 169*b*, respectively, of an appropriate paper or other non-magnetic material. The two core members are bonded together to insure structural integrity. More specifically, suitable epoxy resin bonds 174 and 176, respectively, similar to the bonds 74 and 76, are applied on opposing sides of the core members in the vicinity of the gaps 168 and 170; alternatively, a non-magnetic metal band(s) or spring(s) of various shapes, including "C" and "U" shapes, and positioned about the core members may be employed to maintain the relationship of such members, one with the other. The bonds 174 and 176 cooperatively operate with the channel portion 114, the flange 116 including the groove 165 and notch 124*c*, and the flange 118 including the notch 126*c*, and the spacers 169*a* and 169*b* to maintain the two core members rigidly affixed to the bobbin 112 and in appropriate mutual relationship, thereby effectively forming a rectangular transformer core, disposed generally parallel to the aforementioned plane represented by the center line 137, having gaps 168 and 170 therein.

Referring to FIGS. 10 and 11, an embodiment of a bobbin for a transformer also embodying principles of this invention is shown at 200. The bobbin includes an inner portion 202 and an outer portion 204. The inner portion extends from a base portion 206 and includes an upstanding portion 208 having a central channel 210 and mutually displaced flanges 212 and 214 the flange 212 being disposed at the distal end of the channel 210.

The outer portion 204 of the bobbin 200 includes a central channel 220 and mutually displaced outwardly extending flanges 222 and 224, including notches 222*a* and 224*a*, respectively. The portion 204 also includes an inwardly extending flange 226 substantially adjacent the outwardly extending flange 222.

When the two portions of the bobbin 200 are assembled as shown in FIG. 11, the portion 204 substantially surrounds the portion 202 and the flange 224 rests on a surface 230 outwardly of the flange 214 on the base 206. In addition, the inwardly extending flange 226 overlaps the flange 212 of the inner portion 202. In such fashion, a coil chamber 232 is formed between the channels 210 and 220. In such chamber, a coil 234 (FIGS. 11 and 12) substantially as described above, may be wound about the channel 210; also, a coil 236 may be wound about the channel 220 and maintained in precise displacement from such primary coil by the bobbin portion 204. It should be noted that the spacing $a_2'$ between the two coils may be selected substantially greater than one-third the sum of the thicknesses $a_1'$ and $a_3'$, respectively, of the two coils to achieve improved leakage inductance characteristics as above described. It should also be noted that the flange 226 acts to increase the distance an electric arc would be required to follow through air to pass between the coils, thereby improving the insulation characteristics of such a transformer. L-shaped core members 238 and 240 (shown partially in FIG. 10), substantially as described above, may be positioned about the bobbin 200 in a fashion also described above with legs thereof disposed within the channel 210 and the notches 222*a* and 224*a*.

The base 206 includes passageways 242 to provide access for leads from the coil 236 to respective terminals 244. Such passageways may be rectangular in cross section or may be of various other cross sectional configurations including dovetail shaped as is passageway 242*a*.

The base includes passageways 250 connecting with passageways 242 to provide access for leads from coil 234 to respective terminals 244. Such a lead 252 is shown in FIG. 12 extending from the coil 234, about the channel 210, beneath an extending spur 254 of the flange 214 and through passageways 250 and 242 to a terminal 244. The passageway 250 is substantially T-shaped, including a horizontal portion 250*a* and a vertical portion 250*b*, and extends beneath a planar extension 256 of the surface 230 from an end surface of the base 206 of the vicinity of the upstanding portion 208. The flange 224 of the bobbin portion 204 overlies the planar extension 256 and the passageway 250 when the bobbin is assembled as in FIGS. 10 and 11 to provide increased electric arc length between the coils 234 and 236.

An additional bobbin 300 for a transformer employing principles of this invention is shown in FIGS. 13 and 14. The respective coils and L-shaped cores are substantially as described above and have been omitted to avoid redundancy and clarify description. The bobbin 300 includes a base portion 302, an upstanding portion 304 and a flange 306 at the distal end of such portion 304. The flange 306 includes a recess 308 and the base includes a recess 310. These recesses are all disposed to receive portions of an L-shaped core member in the manner above described. The flange 306 also includes ribs 312, similar in function to the walls 165*b*, which serve together with the recesses 308 and 310 to fix the orientation of the L-shaped cores previously mentioned with respect to the portion 304. A plurality of coils may be wound about the portion 304 in a manner described above. Passageways 316 in the base 302 are provided to permit access for leads from such coils to respective terminals 318.

In this latter regard, it should be observed that the flange 306 includes along its sides a plurality of notches 320*a*, 320*b*, 320*c*, 320*d*, 320*e*, and 322 extending inwardly and obliquely of such flange for supporting leads from coils, (not shown) wound about the portion 304, intermediate such coils and passageways 316. Thus, for example, notches 320*a* and 320*b* (best seen in FIG. 14) cooperatively operate to support a lead 330 from a coil (not shown), intermediate such coil and passageway 316*a*. The notch 322 is provided to cooperatively operate with a notch 320*c* to support a lead 332 intermediate a coil (not shown) and a passageway 316*b*. It should be observed that the notch 322 extends inwardly of the bobbin 300 further than the notch 320*c* or the notches 320*a*, 320*b*, 320*d*, and 320*e* and permits a lead from an inner coil (such as a primary coil similar to those above described) to be supported without its coming in contact or passing through an outer coil (such as secondary coil previously described) wound about the portion 304.

The above description of the invention has been presented in terms of an illustrative and various alternative embodiments thereof. It is not intended, however, that the invention be limited to such embodiments; many additional alternative embodiments of the principles of the invention will become apparent to those skilled in the art to which this invention pertains upon reading this specification. Therefore, it is intended that the invention encompass all those embodiments within the true spirit and scope of the following claims:

What is claimed is:

1. A transformer comprising a base including terminals, hollow support means extending from said base, flange means extending outwardly from said support means at the distal end thereof, first L-shaped core means including a first portion thereof which extends through said hollow support means and a second portion extending along said flange means, and second L-shaped core means including portions positioned in spaced relation with said portions of said first core means to form gaps therebetween, one of said portions of said second core means extending along said base, a plurality of coils positioned about said support means, each of said coils having a plurality of terminal leads connected to respective ones of said terminals, said flange means including a plurality of notches extending inwardly from the edges of said flange means supporting said terminal leads intermediate said coils and said terminals, and means for limiting movement of at least one of said first and second L-shaped core means.

2. A transformer as in claim 1 wherein said means for limiting movement comprises a recess in the edge of said base and a recess in the edge of said flange means for receiving a portion of said core means.

3. A transformer comprising a bobbin having a central channel and mutually displaced first and second flanges extending laterally outward from said central channel, said central channel and first and second flanges being of one piece construction, first and second coils positioned concentrically about said channel, said first and second coils being mutually spaced from one another, said first and second flanges extending laterally beyond said coils on at least one side of said channel, first L-shaped core means having the longer member of the L firmly held in position in an interference fit along its plane within said central channel and extending therethrough and the shorter member of the L extending along said second flange, and second L-shaped core means having the longer member of the L positioned parallel to the longer member of said first core means and in engagement with the distal edges of said first and second flanges and the shorter member of L extending along said first flange, each of said shorter members of said first and second L-shaped core means being of a length which is less than the lateral extent of the respective flange, selected gaps between said first and second core means being defined by the relative dimensions of said flanges and said shorter members.

4. A transformer as in claim 3 wherein said first flange extends to a first dimension and said second flange extends to a second dimension, said shorter member of said first L-shaped core means extending from said longer member of said first core means a dimension less than said second dimension, and said shorter member of said second L-shaped core means extending from said longer member of said second core means a dimension less than said first dimension, whereby a gap of a third dimension is formed between said shorter member of said first core means and said longer member of said second core means and a gap of a fourth dimension is formed between said shorter member of said second core means and said longer member of said first core means.

5. A transformer as in claim 3 wherein said first and second coils each include lead wires and said transformer further comprises termination means comprising a plurality of hole pairs extending through said second flange and a plurality of termination wires, each of said termination wires being respectively passed from a first side of said second flange through one of said holes of a hole pair and back through the other hole of said hole pair, stripped of its insulation and electrically connected to one or more of said lead wires, whereby an exposed end of each said termination wire serves as a termination pin for one or more lead wires.

6. A transformer as in claim 3, 4 or 5 wherein said first and second flanges include a recess in the distal edge thereof for receiving a portion of said core means to position said core means and limit movement thereof whereby the assembly and manufacture of said transformer is facilitated.

* * * * *

UNITED STATES PATENT AND TRADEMARK OFFICE

CERTIFICATE OF CORRECTION

PATENT NO. 4,238,753

DATED December 9, 1980

INVENTOR(S) George S. Bayer

It is certified that error appears in the above-identified patent and that said Letters Patent are hereby corrected as shown below:

Column 3, line 8, "crosssection" should be --cross-section--.
Column 5, line 8, "onethird" should be --one-third--.
Column 5, line 35, delete "to".
Column 6, line 34, delete "the".
Column 6, line 56, after "to" insert --the--.
Column 7, line 25, "hole" should be --holes--.
Column 7, line 26, "pair" should be --pairs--.
Column 7, line 39, "14" should be --114--.
Column 9, line 46, "of" (second occurrence) should be --to--.
Column 10, line 21, insert --a-- before "secondary."
Column 10, line 60, insert --said-- before "first."
Column 11, line 6, insert --the-- before "L."

Signed and Sealed this

*Third* Day of *November 1981*

[SEAL]

*Attest:*

GERALD J. MOSSINGHOFF

*Attesting Officer*

*Commissioner of Patents and Trademarks*